United States Patent [19]

Hart

[11] Patent Number: 4,892,290

[45] Date of Patent: Jan. 9, 1990

[54] COMBINATION HOIST AND STAND

[76] Inventor: John A. Hart, Box 578, Claresholm, Alberta, Canada, T0L 0T0

[21] Appl. No.: 194,341

[22] Filed: May 16, 1988

[51] Int. Cl.[4] ..... B66F 7/26

[52] U.S. Cl. ..... 254/49

[58] Field of Search ..... 254/45-50, 254/94; 414/498

[56] References Cited

U.S. PATENT DOCUMENTS

| | | | |
|---|---|---|---|
| 3,251,494 | 5/1966 | Pulliam | 414/498 |
| 3,672,524 | 6/1972 | Conrad | 254/49 |
| 3,715,100 | 2/1973 | Spencer | 254/49 |

*Primary Examiner*—Robert C. Watson

*Attorney, Agent, or Firm*—George H. Dunsmuir

[57] ABSTRACT

The majority of combination lifts and carrying frames for use on vehicles such as pickup trucks are complicated including fixed and movable frames, pulleys, chains and even winches. A relatively simple combination lift and stand for use on such a vehicle includes an L-shaped frame for carrying by a vehicle in a collapsed condition with the vertical arm of the L near the cab of the vehicle; and extensible legs pivotally connected to each end of the frame for rotation between stored and inclined, ground engaging positions, whereby, when the legs are rotated from the stored to the ground engaging position and the vehicle is driven in reverse, the frame is pushed to an erect, stand position, and subsequent forward movement of the vehicle leaves the device alone in the erect, stand position. The procedure can be reversed, by driving the vehicle in reverse beneath the stand, attaching the stand to the vehicle and driving forward to cause the stand to collapse onto the vehicle.

5 Claims, 4 Drawing Sheets

COMBINATION HOIST AND STAND

BACKGROUND TO THE INVENTION

This invention relates to a stand, and in particular to a combination lift and stand device.

The lift and stand device proposed herein is intended for use on a truck or other vehicle of the type including a flat bed for carrying the device. Typically, the vehicle is a pickup truck with a cab and integral box structure. In general, lift and stand devices for use on vehicles of this type are unnecessarily complicated. In this connection, reference is made to U.S. Pat. No. 4,239,438, which issued to C. R. Everson on Dec. 16, 1980. The Everson device typifies available lifts and stands, which generally rely on fixed and folding frames, and pulleys and cables for moving the folding frames between loading and transport positions.

The object of the present invention is to overcome the drawbacks of existing devices by providing a relatively simple combination lift and stand device, which folds to a compact storage position and which is easy to use.

BRIEF SUMMARY OF THE INVENTION

Accordingly, the present invention relates to a portable lift and stand device comprising frame means for mounting on a vehicle in a collapsed condition; and leg means pivotally connected to each end of said frame means for rotation between stored and inclined, ground engaging stand positions, whereby, when said leg means are rotated from the stored to the ground engaging position and the vehicle is moved in a direction towards said frame means, said frame means is pushed to an erect, stand position, and subsequent movement of the vehicle away from the frame means leaves the device alone in the erect, stand position.

BRIEF DESCRIPTION OF THE DRAWINGS

The invention will be described in greater detail with reference to the accompanying drawings, which illustrate a preferred embodiment of the invention, and wherein.

With reference to the drawings, the device of the present invention, which is generally indicated at 1 is intended for use on a pickup truck 2 of the type including a cab 3 and a box 4 on the rear thereof. The device 1 is retained in the box 4 when in use to carry articles (not shown).

Figure 1:
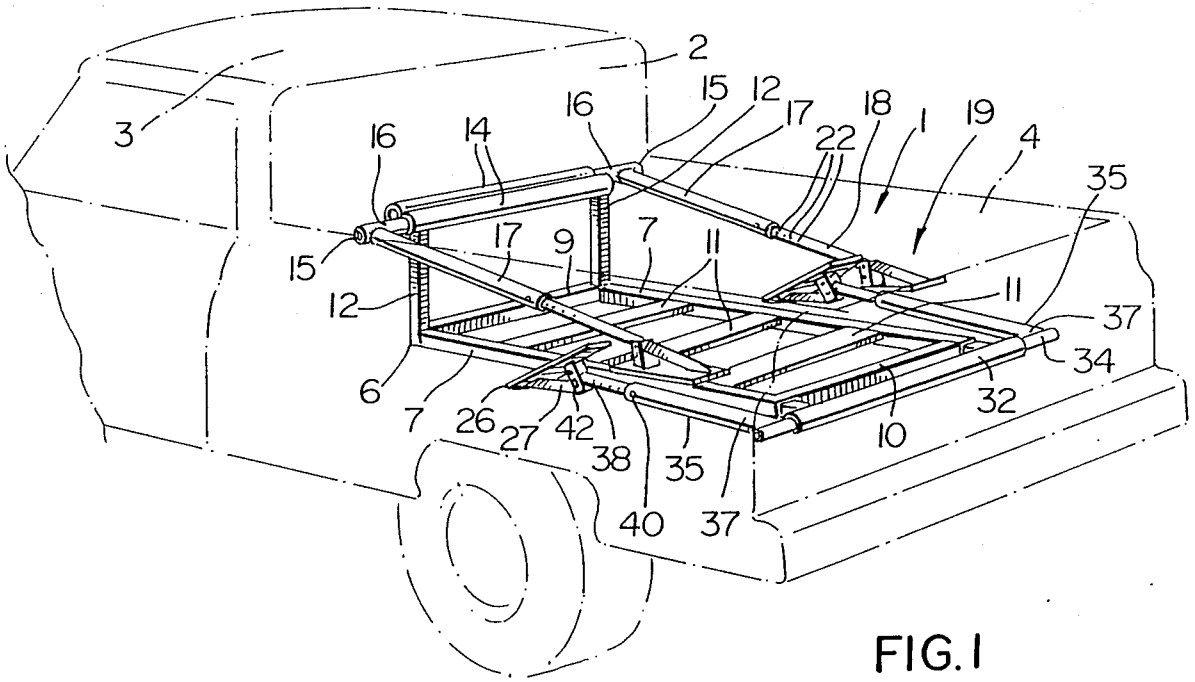
FIG. 1 is a schematic, perspective view from the rear of a combination lift and stand device in accordance with the present invention in the folded or storage position.
Figure 2:
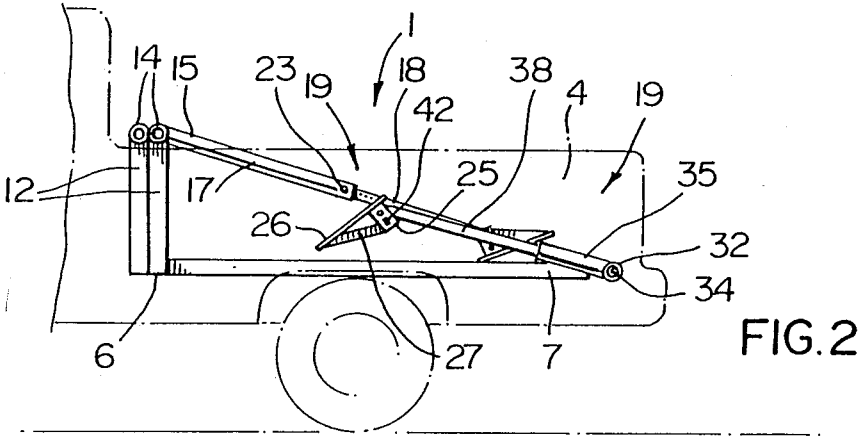
FIG. 2 is a schematic, side view of the device of FIG. 1.

The lift and stand device 1 is defined by an L-shaped frame 6, which includes a base defined by tubular sides 7 interconnected by front and rear ends 9 and 10, respectively (FIGS. 1 and 6), and crossbars 11. Posts 12 are mounted on each corner of the front end 9 of the frame 6 for supporting the ends of a pair of parallel, interconnected sleeves 14. The sleeves 14 carry inverted L-shaped legs 15, each of which includes a horizontal arm 16 slidably mounted on a sleeve 14, and a tubular vertical arm 17. An extension 18, forming part of the leg 15, is slidably mounted in the arm 17, and a foot, generally indicated at 19, is mounted on the bottom end of the arm 17. The extension 18 is slidable in the arm 17, and includes a row of holes 22 for receiving a pin 23 for securing the extension 18 in one of various positions, i.e. for making the length of the leg adjustable. Each foot 19 includes a vertical bracket 25, a flat base plate 26 and a diagonal brace 27 extending between the bracket 25 and the plate 26. The bracket 25 is defined by a square cross section tube with the front side removed therefrom. The foot 19 is pivotally connected to the bottom end of the leg extension 18 by a pin 29 extending transversely through the bracket 25 and the bottom end of the extension.

An extension generally indicated at 30 (FIGS. 4 to 6) is slidably mounted in the rear end of the frame 6. The extension 30 is U-shaped, including a pair of tubular sides 31 which are slidably mounted in the square cross section tubular sides 7 of the frame 6, and a tubular rear end or sleeve 32 extending between the sides 31. A tubular shaft 34 is rotatably mounted in the sleeve 32. A leg 35 is mounted on each end of the shaft 34. Each leg 35 is defined by a top sleeve 37 and a bottom portion 38 slidably therein. A row of holes 39 is provided in the bottom portion 38 for receiving a pin 40, so that the length of the leg can be adjusted.

A foot 19 is provided on each leg 35. The rear feet 19 are identical to the front feet, except that a lug 42 is provided on the bracket 25 of each rear foot for securing one end of a chain 43 (FIGS. 5 and 6) to the foot. The other end of the chain 43 is permanently connected to one end of the rearmost sleeve 14. The chains 43 on each side of the frame limit rotation of the front legs when the device is in the erect position (FIG. 6), i.e. prevent collapsing of the device from the erect position.

In use, the device 1 is carried collapsed and folded in a pickup truck 2 or other vehicle with a flat bed. The device 1 is folded in such a manner that the rear legs 35 rest on the top surfaces of the vehicle wheel wells (not shown) along the outside of the base of the frame 6, and the vertical arms 17 of the front legs 15 are inclined downwardly with the feet 19 resting on the top surfaces of the wheel wells outside of the rear legs 35. The crossbars 11 are used to support a load. A plywood or other panel (not shown) can be provided on the crossbars 11 to form a continuous, planar support surface.

Figure 3:
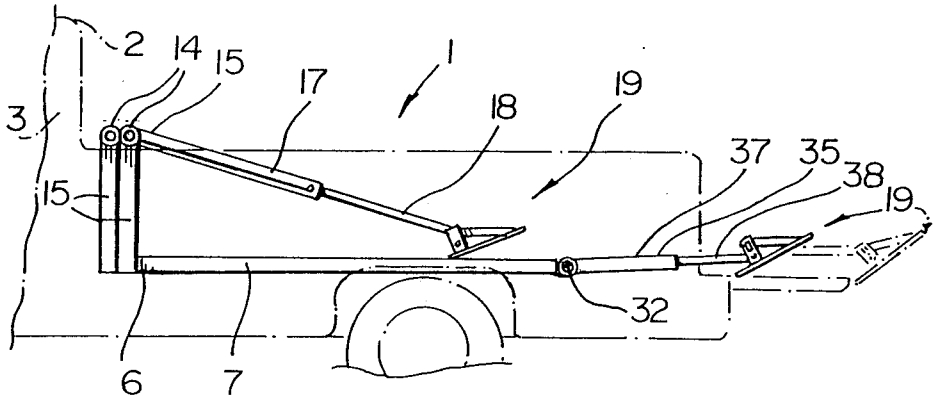
FIGS. 3, 4 and 5 are schematic side views of the device of FIGS. 1 and 2 in various positions.
Figure 4:
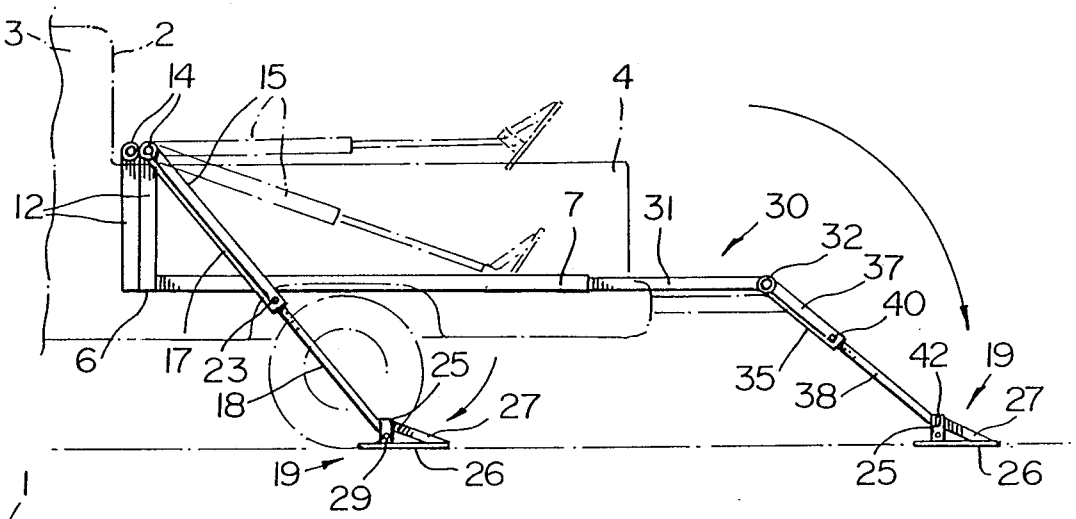
Figure 5:
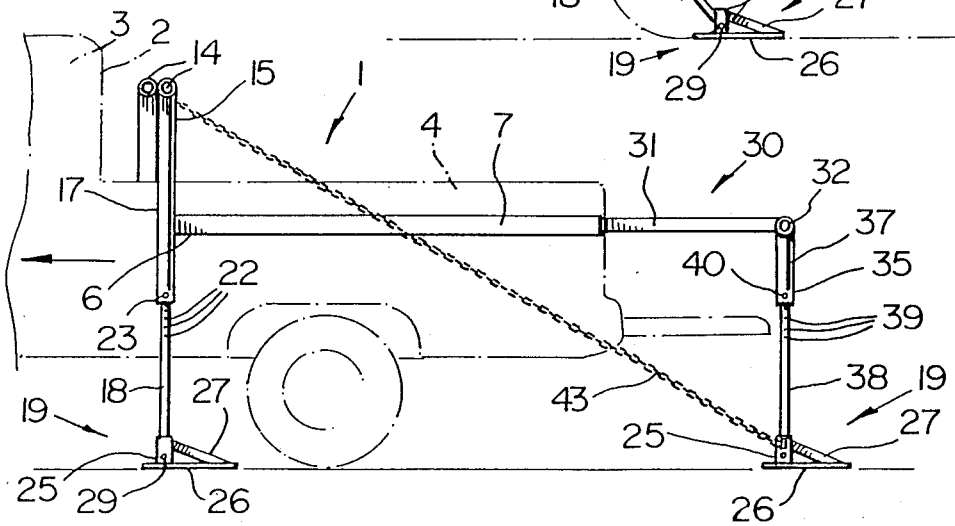
Figure 6:
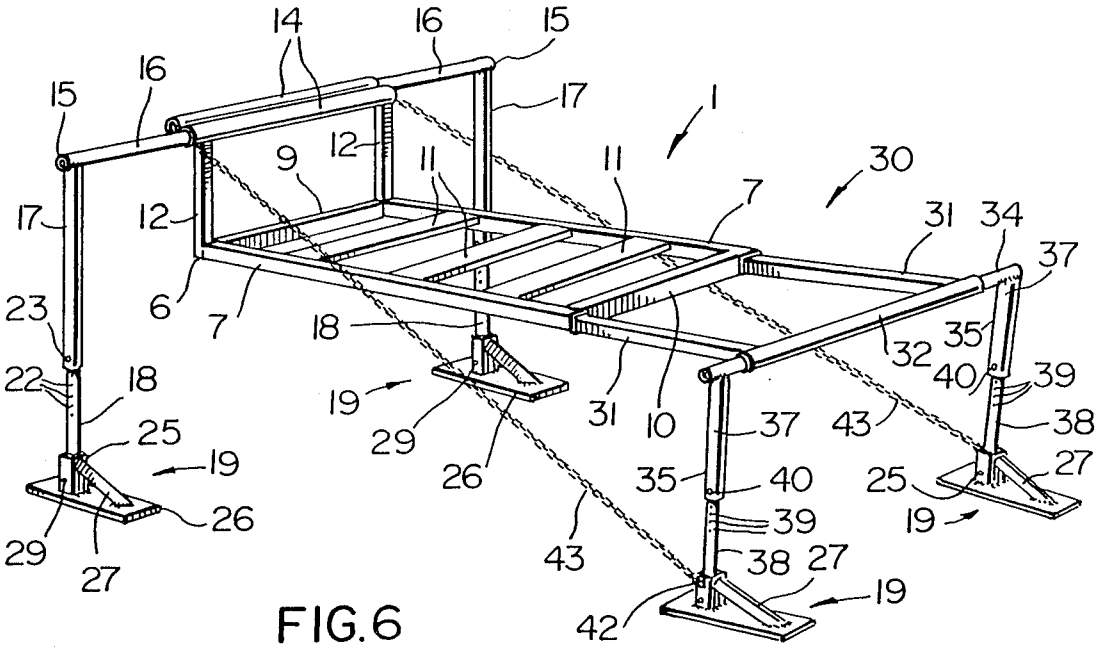
FIG. 6 is a schematic, perspective view of the device of FIGS. 1 to 5 in the fully erect or stand position.

In order to unload the device 1 and the load thereon, the vehicle tailgate 45 (FIGS. 4 and 5) is lowered, and the rear legs 35 are unfolded, i.e. rotated with the shaft 34 around the longitudinal axis of the sleeve 32 of the extension 30 (FIG. 3). The extension 30 is then pulled out of the frame 6, and the rear legs 35 are rotated further into the ground engaging position (FIG. 4). The front legs 15 are lifted above the sides of the truck box 4, the arms 16 are slid outwardly, and the legs are lowered to the ground engaging position. The truck 2 is driven in reverse so that the rear of the cab 3 pushes against the vertical arm of the frame 6, i.e. against the sleeves 14 or the bottom ends of the posts 12 which causes the device to rotate to the erect position (FIG. 6). The chains 43 are then attached to the lugs 42.

In the erect position, the rear legs 35 are inclined slightly upwardly and rearwardly, so that the bottom ends thereof press against the closed rear ends of the brackets 25. For such purpose, all of the feet brackets 25 open in a forward direction. Thus, the legs 35 cannot rotate beyond the slightly rearwardly inclined position. The chains 43 hold the front end of the frame, and thus prevent forward rotation of the frame around the top ends of the legs 15, i.e. around the longitudinal axes of the sleeves 14 to the collapsed position.

The device 1 and the load can be left standing indefinitely. In order to replace the device in the truck 2, the chains 43 are disconnected from the rear feet brackets 25, and the truck 2 is backed into position beneath the frame 6. The chains 43 (near the sleeve ends thereof) are connected to the front of the vehicle box 4, and the vehicle 2 is driven forward so that the frame 6 settles onto the floor of the box 4. The leg raising and folding procedure is the reverse of the leg unfolding and lowering procedure.

Thus, there has been described a relatively simple, skeletal lift and stand device, which is structurally sound and easy to use.

What is claimed is:

1. A portable lift and stand device comprising an L-shaped extendible frame means for mounting on a vehicle in a collapsed condition and an extension slidable in said frame or movement between a storage position and an extended use position, leg means extendible between storage and ground engageable positions and pivotally connected to each end of said frame means for rotation between storage and inclined, ground engaging positions, whereby when said leg means are rotated from the stored to the ground engaging positions and the vehicle is moved in a first direction, said frame means is pushed to an erect, stand position, and subsequent movement of the vehicle in a second, opposite position leaves the device in an erect, standing position, said frame means being substantially L-shaped for engaging horizontal and vertical portions of a vehicle whereby during movement of the vehicle in said first direction, the vertical portion of the vehicle engages the vertical arm of the frame means to cause rotation of the frame means about the leg means to the erect position, and said frame means being extendible.

2. A device according to claim 1, wherein said leg means includes first legs Pivotally connected to the top of the vertical arm of the frame; and second legs pivotally connected to an outer free end of said extension at the other end of said frame means.

3. A device according to claim 2, including chain means for connecting the vertical arm of said frame to a bottom end of said second legs at an opposite end of said frame to prevent rotation of said leg means in one direction relative to said frame.

4. A device according to claim 3, including foot means pivotal on the bottom end of each said legs for supporting the device.

5. A device according to claim 4, wherein said foot means includes bracket means for limiting rotation of said legs in the direction opposite to said one direction relative to said frame.

* * * * *